United States Patent [19]

Mine et al.

[11] Patent Number: 4,725,181

[45] Date of Patent: Feb. 16, 1988

[54] METHOD OF AND APPARATUS FOR STORING TOBACCO OR THE LIKE IN HIGH STACKS AND DISCHARGING THE SAME

[75] Inventors: Taiichi Mine, Hadano; Takashi Watanabe, Takamatsu, both of Japan

[73] Assignee: Japan Tobacco, Inc., Tokyo, Japan

[21] Appl. No.: 848,208

[22] Filed: Apr. 4, 1986

Related U.S. Application Data

[63] Continuation-in-part of Ser. No. 550,102, Nov. 9, 1983, abandoned.

[30] Foreign Application Priority Data

Nov. 10, 1982 [JP] Japan ..... 57-196033

[51] Int. Cl.[4] ..... B65G 47/19

[52] U.S. Cl. ..... 414/49; 198/369; 198/451; 239/681; 414/268; 414/786

[58] Field of Search ..... 198/358, 369, 447, 451; 239/681; 414/28, 267, 268, 272, 49, 104, 786

[56] References Cited

U.S. PATENT DOCUMENTS

| | | | |
|---|---|---|---|
| 3,365,083 | 1/1968 | Baumann et al. | 198/358 X |
| 3,735,881 | 5/1973 | Wilding | 414/786 |
| 3,817,369 | 6/1974 | Bluthardt et al. | 198/358 X |
| 4,037,712 | 7/1977 | Wochnowski | 198/358 X |
| 4,081,088 | 3/1978 | Rysti | 198/447 X |

FOREIGN PATENT DOCUMENTS

| | | | |
|---|---|---|---|
| 1434421 | 5/1976 | United Kingdom | 414/272 |

*Primary Examiner*—Frank E. Werner
*Assistant Examiner*—Janice Krizek

[57] ABSTRACT

Method of and apparatus for storing tobacco or the like in high stacks and discharging the same, in which tobacco is charged into and stored in a plurality of vertically elongated storage chambers arranged side by side. The tobacco is discharged to fall onto a discharging conveyor arranged horizontally beneath the storage chambers, while changing the orientation of the tobacco layer from a horizontal to a vertical direction. The tobacco layer oriented in a vertical direction is transported by the discharging conveyor. Completion of the discharge is detected and then discharging the tobacco of the next chamber is started. Separating doffers are provided for cooperation with the discharging conveyor.

7 Claims, 9 Drawing Figures

METHOD OF AND APPARATUS FOR STORING TOBACCO OR THE LIKE IN HIGH STACKS AND DISCHARGING THE SAME

This application is a Continuation-in-part application of U.S. patent application Ser. No. 550,102, now abandoned.

BACKGROUND OF THE INVENTION

This invention relates to a method and apparatus for storing tobacco or the like in a high stack and discharging the same.

In a prior art apparatus for storing tobacco, tobacco is stored as a stack directly on a belt conveyor. In this case, if tobacco is stacked as a too high stack, the quality of tobacco is adversely affected, due to its own weight, that is, there is a limitation on the height of the stack. Therefore, the apparatus is inevitably large in size and requires a large installation area. Further, when storing separate tobacco leaves in a controlled moisture content state in the apparatus, they form a bridge of a large mass for they are stacked in a horizontally overlapped condition. At the time of discharging, such mass of tobacco leaves is discharged as such from a head section of the storing conveyor which is being driven. Such lump of tobacco leaves cannot be stably supplied to the next process station. If such mass of tobacco leaves is unraveled into predetermined quantities using an unraveling mechanism, the mesophyll of the tobacco leaves are seriously damaged. For the above reasons, tobacco leaves can be stacked only as high as approximately 1.2 m. Further, where tobacco leaves free of stems shredded tobacco leaves are piled up in a high stack, it is liable that the lower part of the stack is compressed and densely bound together. Also, breakage of tobacco leaves and adverse effects on the quality of tobacco such as aroma are expected. Further, adverse effects on the smoking taste of tobacco are likely. For the above reasons, the upper limit of the stack height is usually about 1.2 m (1.5 m max.) in case of cut tobacco leaves free from stems and 0.5 m(0.7 m max.) in case of shredded or cut tobacco. Accordingly, usually a plurality of storage conveyors are stacked one above another. In a further aspect, tobacco is usually stacked in the storing conveyor for the purpose of blending, and it is stacked to varying heights unless the stacking is done using a stacking conveyor which is reciprocable over the entire length of the storing conveyor. Therefore, it is difficult to permit the stored tobacco to be discharged at a constant rate.

SUMMARY OF THE INVENTION

It is an object of the present invention to provide a method and an apparatus for storing tobacco or the like in high stack and discharging the same, which can overcome the drawbacks described above inherent in the prior art.

DETAILED DESCRIPTION OF THE EMBODIMENTS

Figure 1:
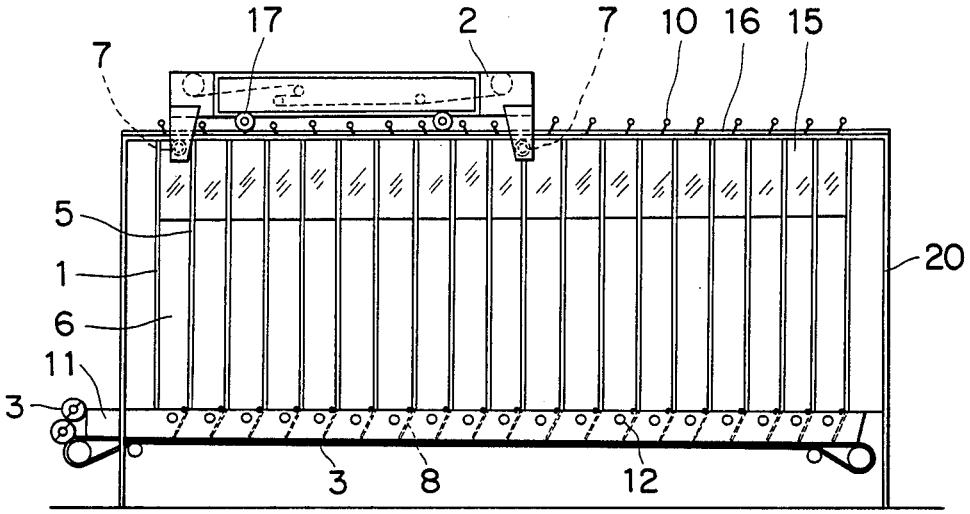
FIG. 1 is a side view showing an embodiment of the invention.

An embodiment of the invention will now be described with reference to the accompanying drawings. Referring to FIG. 1, there is shown the apparatus according to the invention which comprises a box-like storage section 1. A conveyor 2 for charging is provided over the storage section 1. A horizontal conveyor 3 for discharging is provided beneath the storage section 1. The storage section 1 has opposite side walls 4, and its interior space is divided by partition walls 5 into a plurality of vertically elongate storage chambers 6 arranged juxtaposed in a row extending in the direction of progress of the discharging conveyor 3. In more detail, the horizontal conveyor 3 runs in a predetermined direction. Above said conveyor 3, there is provided the storage section 1 composed of a plurality of vertically elongate chambers juxtaposed in a row. Each chamber 6 is defined by a plurality of walls which include a first partition wall 5 extending perpendicular to said predetermined direction, a pair of side walls 4 extending on a downstream side of said first partition wall parallelly to said predetermined direction and a second partition wall 5 extending parallelly on the downstream side of the first partition wall 5. A floor gate 8 is hinged to said first partition wall at a bottom end thereof to open and close on a downstream side of the first partition wall. The horizontal conveyor 3 is spaced apart from the each chamber 6 by a distance substantially equal to said size of each sidewall 4, said each side wall having at least one transparent window therein. A pair of transparent tobacco support plates 11 are erected to extend in said predetermined direction for holding tobacco leaves which are discharged between the chambers 6 and the conveyor 3. The distance between adjacent partition walls 5 is selected according to the character of tobacco. More specifically, it is set such that a pressure is applied to the partition walls 5 by the orientation of tobacco as a layer and the weight of tobacco in each storage chamber is not entirely applied to the bottom thereof. The thickness of the tobacco layer on the discharging conveyor 3 is substantially equal to the distance noted. The distance is thus usually roughly 0.6 m and up to approximately 0.8 m.

Figure 2:
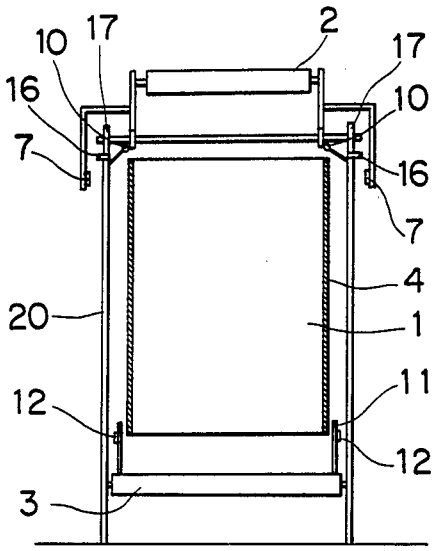
FIG. 2 is a sectional view showing the same embodiment.
Figure 3:
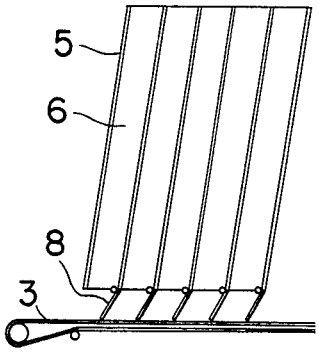
FIG. 3 is a view showing inclined partition walls according to the invention.
Figure 4:
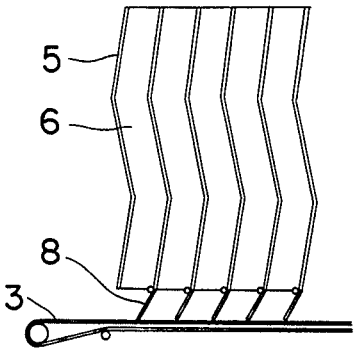
FIG. 4 is a view showing zig-zag partition walls according to the invention.

The individual partition walls 5 may be inclined from the vertical depending on the character of tobacco. The inclination angle is set in a range up to about 70 degrees from the horizontal as shown in FIG. 3. In the case of shredded tobacco or pipe tobacco or the like where the load on the bottom of the storage chamber has to be alleviated, zig-zag partition walls as shown in FIG. 4 may be provided within the inclination angle range noted above. The side walls 4 are usually disposed upright as shown in FIG. 2. However, they may be disposed such that they flare slightly toward the bottom to allow smooth discharge of tobacco from the bottom of the storage chamber. The height of the storage chamber is restricted by the height of the ceiling of the factory, and in the instant embodiment it may be set from 3 to 6 m. However, it may be as high as possible otherwise. The side walls 4 have opposed transparent windows 15 formed in their upper portions to see therethrough. Detectors (for instance photoelectric detectors) 7 for detecting the height of tobacco loaded in the storage chambers 6 are provided at the front and rear ends of the loading conveyor 2.

Figure 5:
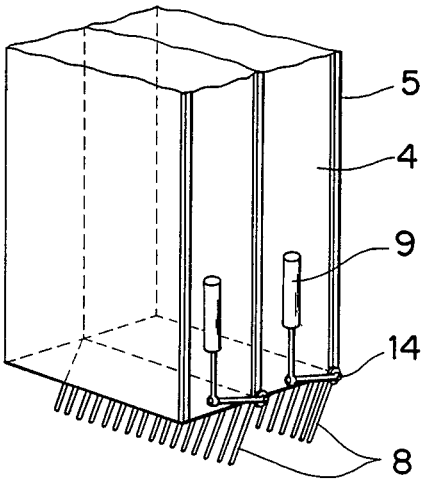
FIG. 5 is a view showing gates of the storing apparatus according to the invention.

Each storage chamber 6 has a floor plate 8 provided at one side of the bottom. The floor plate 8 is closed when loading tobacco and is opened when discharging tobacco. FIG. 5 shows the floor plate 8 in another embodiment detail. This example of floor plate 8 has a rake-like shape, which is effective for quickly exhausting air corresponding in volume to the loaded tobacco and also air accompanying thereto. This is desired from the stand-points of preventing the floating-up and scattering of part of contained tobacco depending on the character thereof (such as size and bulk density) and also at the time of loading from above, and also quick settling of the loaded tobacco into a stable state. The floor plate 8 is pivotally supported to the bottom of the first partition wall 5 by a support rod or pin 14 such that it can be opened to the direction of progress of the discharging conveyor 3. It is opened and closed by a floor plate driver 9 (for instance an air cylinder or an oil hydraulic cylinder) mounted on either side wall 4.

The charging conveyor 2 can be reciprocated along rails 16 provided on top of a frame member 20. A limit switch 10 for determining a stop position of the charging conveyor 2 is provided on top of said frame member 20. The discharging conveyor 3 is disposed such that it is spaced apart from the floor plate 8 provided at the bottom of each storage chamber 6 of the storage section 1 by a distance slightly greater than the distance between adjacent partition walls 5 (for instance about 0.1 m).

Figure 7A:
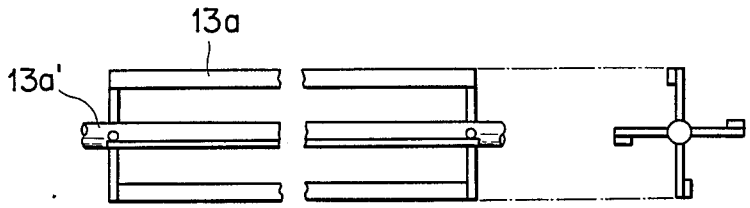
Figure 7B:
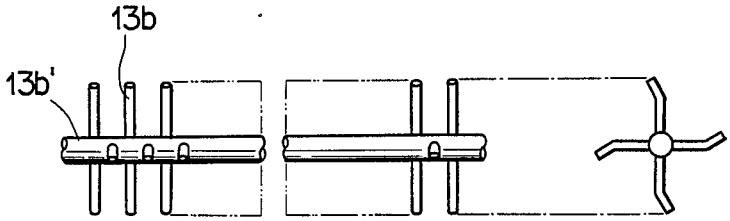
Figure 7C:
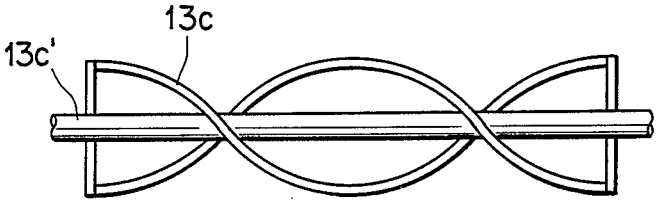

The transparent tobacco support plates 11 are spaced apart by a distance slightly greater than the distance between the side walls 4 forming the storage section. Said frame member 20 is provided with detectors 12 (photoelectric detectors in this embodiment) for detecting the completion of discharge of tobacco from the respective storage chambers 6. The tail section of the discharging conveyor 3 is provided with separating doffers 13. Said doffers 13 may be of a paddle type (FIG. 7*a*), a pin type (FIG. 7*b*), and a spiral-type (FIG. 7*c*). In each of the types, a paddle member 13*a*, a pin member 13*b* or a spiral member 13*c* is mounted on a shaft 13*a*', 13*b*' or 13*c*' for rotary movement in the arrow-marked direction.

Said discharging conveyor 3, said limit switches 10, and said rails 10 are all secured to the frame member 20.

Figure 6:
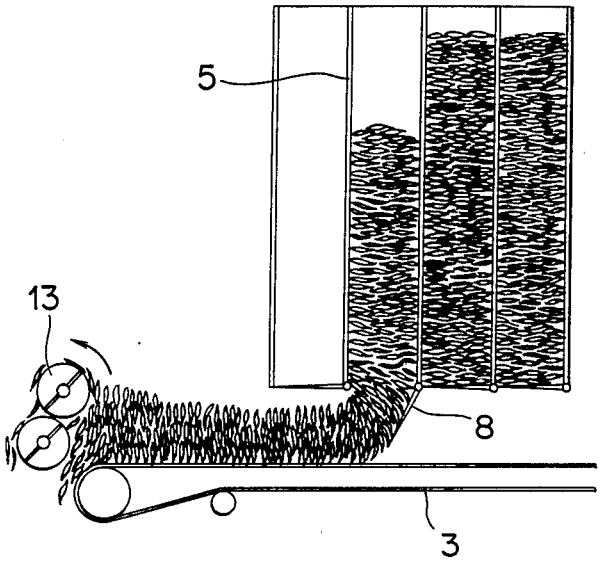
FIG. 6 is a view showing the storing apparatus in a state discharging stored tobacco; and FIGS. *7a* to *7c* are views showing various types of doffers.

Tobacco supplied to the charging conveyor 2 is charged therefrom into each storage chamber 6. At this time, the gate provided at the bottom of the storage chamber 6 is held closed. When the upper limit of the storage chamber is reached by tobacco being charged and is detected by the detector 7, the conveyor belt of the charging conveyor 2 stops supplying tobacco and the conveyor 2 is then moved to a position for the next storage chamber as determined by the corresponding limit switch 10. As soon as the conveyor 2 is brought to this position, its conveyor belt is driven again to start charging of tobacco. When this storage chamber becomes full of tobacco, the conveyor is moved to a further storage chamber. Tobacco is charged into the successive storage chambers in the above way. When charging tobacco into the front half of the storage section, tobacco is charged from the front end of the charging conveyor 2, while for charging tobacco into the rear half of the storage section it is charged from the rear end of the conveyor 2. The stepwise movement of the conveyor 2 and driving of the conveyor belt are controlled accordingly. The tobacco stored in the individual storage chambers 6 is discharged by successively opening the floor plates 8 of the storage chambers. The floor plates 8 are opened sequentially from the side of the first storage chamber. With the gate opened, the stored tobacco is allowed to fall continuously onto the discharging conveyor 3. At this time, it is guided by the inclined surface of the gate. With the progress of the conveyor belt of the discharging conveyor 3, the tobacco reaching the conveyor changes the direction in a L-shaped fashion to change the orientation of the tobacco leaves as shown in FIG. 6 and transported as a layer on the conveyor having a height substantially equal to the distance between adjacent partition walls. When the completion of discharge is detected by the detector 12, the gate of the next storage chamber full of tobacco is opened at a timing such that a continuous tobacco layer is formed on the conveyor to be discharged continuously therefrom. At the tail end of the conveyor 3, said continuous tobacco layer composed of vertically orientated tobacco leaves is separated piece by piece by means of the rotating doffers 13 to be supplied to the subsequent step of the process.

As has been shown, when tobacco is stacked in a high stack according to the invention, the extent of compression of the lower layer of the stack can be reduced for part of the load is applied as side pressure to the partition walls. Particularly, it has been proved that where zig-zag partition walls are used the load of tobacco above the first bent point of the partition wall from the lower ends has no effect on the compression. In addition, the stored tobacco can be discharged stably as a layer of a small height. Thus, it is readily possible to set a desired rate of discharge. Further, when tobacco leaves stacked in the storage chamber in the orientation parallel to the surface of the discharging conveyor are transferred onto the conveyor, their orientation is changed to be perpendicular to conveyor surface, so that they can be readily and smoothly separated by the doffers provided at the tail end of the discharging conveyor. Thus their breakage can be reduced, and also they can be supplied to the next step of the process at a constant rate. It is thus possible to stack even tobacco leaves or the like liable of getting into a lump in as high stack as possible. A compact storing apparatus requiring a small installation area thus can be provided.

What is claimed is:

1. A method of storing tobacco or the like in high stacks and discharging the same, which comprises the steps of:

(a) charging tobacco leaves into a plurality of storage chambers including juxtaposed first and second storage chambers to form a tobacco layer within each chamber, with said tobacco leaves horizontally oriented;

(b) controlling said tobacco layer to a stack level avoiding compression of the leaves in a vertical direction;

(c) discharging the tobacco layer in the first storage chamber onto a discharging conveyor in motion while changing the orientation of the tobacco leaves to a vertical orientation by guiding said tobacco layer to turn by substantially 90 degrees;

(d) transporting the tobacco layer on the discharging conveyor to discharge the same at an end of the discharging conveyor;

(e) detecting completion of the discharge of the tobacco layer in the first chamber to start discharging the tobacco layer of the second chamber with a timing such that a continuous tobacco layer is formed on the conveyor to be discharged continuously therefrom; and (f) separating said continuous layer piece by piece at a tail section of said discharging conveyor.

2. A method according to claim 1, wherein said steps (a) to (f) are controllably repeated.

3. An apparatus for storing tobacco or the like in high stacks and discharging the same, which comprises:

horizontal discharging conveyor means running in a predetermined direction;

a plurality of vertically elongate storage chambers juxtaposed in a row above said conveyor means, each chamber being defined by a plurality of walls including a partition wall extending perpendicular to said predetermined direction and a pair of sidewalls extending on a downstream side of said partition wall parallel to said predetermined direction and having a predetermined size in said predetermined direction, and a floor plate hinged to said partition wall at a bottom end thereof to open and close on a downstream side of the partition wall;

tobacco supplying means provided above said plurality of chambers to charge said chambers with horizontally oriented tobacco leaves;

said horizontal conveyor means being spaced apart from said chambers by a distance substantially equal to said size of each sidewall, each sidewall having at least one transparent window therein;

a pair of transparent tobacco support plates erected substantially parallel to said sidewalls between said chambers and the conveyor means, whereby said tobacco leaves become vertically oriented into a continuous tobacco layer on said discharging conveyor means; and doffer means at a tail section of said discharging conveyor for separating the continuous tobacco layer piece by piece.

4. An apparatus according to claim 3, wherein each storage chamber is inclined in said predetermined direction.

5. An apparatus according to claim 3, wherein each storage chamber has zig-zag partition walls, said zig-zag partition walls having a first bent point above the bottom end.

6. An apparatus according to claim 3, further including detecting means outside said pair of transparent tobacco support plates to detect the completion of the discharge therethrough.

7. An apparatus according to claim 3, wherein said tobacco supplying means includes a charging conveyor having detecting means to detect a desired height of the tobacco leaves in a stack through said transparent window in the sidewall.

* * * * *